United States Patent [19]

Blumenkranz et al.

[11] Patent Number: 4,971,210

[45] Date of Patent: Nov. 20, 1990

[54] CLAMSHELL-TYPE CLOSET ROD SPACER UNIT

[75] Inventors: Stephen J. Blumenkranz, Redwood City, Calif.; Steven L. Stenberg, 433 Harlan St. #266, San Leandro, Calif. 94577

[73] Assignee: Steven L. Stenberg, San Leandro, Calif.

[21] Appl. No.: 293,743

[22] Filed: Jan. 3, 1989

[51] Int. Cl.[5] ..... A47G 25/00

[52] U.S. Cl. ..... 211/123; 211/105.1

[58] Field of Search ..... 211/123, 124, 184, 105.1; 24/20 TT, 543

[56] References Cited

U.S. PATENT DOCUMENTS

| | | | |
|---|---|---|---|
| 234,799 | 11/1880 | Neely | 24/20 TT |
| 316,310 | 4/1885 | Eych | 24/543 |
| 1,379,476 | 5/1921 | Parr | 24/543 |
| 1,934,170 | 11/1933 | Crooks . | |
| 2,058,416 | 10/1936 | Comstock . | |
| 2,525,169 | 10/1950 | Dodge . | |
| 2,608,409 | 8/1952 | Pinkerton . | |
| 2,713,525 | 7/1955 | Himman . | |
| 2,868,389 | 1/1959 | Friend . | |
| 3,940,085 | 2/1976 | Campbell . | |
| 4,577,766 | 3/1986 | Miller . | |
| 4,729,482 | 3/1988 | Nicholson . | |
| 4,760,929 | 8/1988 | Fedorchak . | |

*Primary Examiner*—David M. Purol
*Assistant Examiner*—Sarah A. Lechok
*Attorney, Agent, or Firm*—Jacques M. Dulin

[57] ABSTRACT

A spacer to maintain separation between garments on hangers hanging on a clothes rod being a collar having a clam shell construction so that the spacer can be opening for attachment to, or removal from, the closet rod thereby avoiding the necessity of removing the bar from the closet. In preferred embodiment the spacer is generally cylindrical of diameter greater than the inner diameter of the coat hanger hook and having rounded ends to cause the hangers to rest on the rod. One or more hook retaining grooves may be included medially of the ends. Snap closure means secures the two hemi-shells closed. At least one of the shells may be decoratively configured, e.g. a Disney character or the like to appeal to children. The plastic may be color-coded or labeled.

14 Claims, 2 Drawing Sheets

CLAMSHELL-TYPE CLOSET ROD SPACER UNIT

FIELD

This invention relates to spacers that may be positioned on a horizontal clothes bar in order to maintain the proper spacing between garments hung on hangers on the clothes bar so that the hangers are not laterally pushed together, thereby crushing the clothes and causing wrinkles. More particularly the invention relates to special spacers of "clamshell" design that may be mounted or dismounted from the rod without the necessity of removing clothes and hangers and dismounting the rod from its support brackets.

BACKGROUND

The universal method of storing garments is to drape each garment on the well-known wire hanger shaped for the purpose and having a hook which may be "hooked" into a horizontal bar. Such bars are often located in a clothes closet that is poorly lighted making it difficult for a person to find and withdraw a particular garment from the bar when many garments are hung on the bar pushed together to form a close stack. Furthermore, when the garments form a close stack the garment will be crushed and not hang "straight" resulting in wrinkling. In addition, as the person slides hangers on the bar seeking to find a particular garment, some of the garments tend to slide off the hanger and fall to the floor.

Spacers have been developed which may be positioned on the bar in order to maintain each garment at a preset distance from its neighboring garments.

For example, U.S. Pat. No. 2,868,389 describes a plurality of tubes that slide onto the bar so that each end of each tube may butt against an end of a neighboring tube. Each tube has at least one groove circumferentially formed on its outer surface so that the hook of a hanger may rest in the groove and may thereby be secured at a distance from its neighbor. A split ring design is also suggested (Column 2 Line 64–69). The problem with this design is that the hangers can rest on the surface of the sleeve or easily come out of the shallow groove, thus not accomplishing maintaining the spacing of the hangers.

U.S. Pat. No. 4,577,766 discloses a triple flange spool assembly (a tube with disks spaced laterally apart from one another). A variety of groove types are used to accommodate a variety of hanger hook types. The spool ends (discs) abut. This design also presents the inconvenience of removing the clothes bar to slide the spacer onto the bar. Also it is difficult to transfer a hanger from one groove to another when needed.

U S. Pat. No. 4,760,929 discloses a design in which the spacing element is a partial section of a cylinder having a longitudinal (slit) opening defined by two straight parallel edges. The cylinder section is flexible so that the straight edges may be momentarily spread apart in order to allow the cylinder section to clamp onto the supporting bar. One side of the cylinder section has a straight notched ridge for receiving the hangers. The problem with this construction is that loss of clamping force due to the general nature of plastics or slight variations of the diameter of a bar from a mean diameter allows the spacer to rotate on the bar and orient the notched ridge to a position that negates its intended purpose, i.e. gravity will cause the fin to rotate under the bar.

Other examples of art such as spacers or rollers for towels which show variations of design that do not anticipate this invention include: U.S. Pat. No. 2,058,416 which shows a clip to prevent towels from slipping off towel bars; and U.S. Pat. No. 4,729,482 which shows a rotatable round sleeve to fit on a square towel bar.

Devices not intended for the purposes of this invention have been suggested in the literature. U.S. Pat. No. 2,608,409 shows a slotted weight for a golf club; 1,934 170 shows a textile machinery spool; U.S. Pat. No. 2,525,169 shows a cork hub for a fishing reel; U.S. Pat. No. 3,940,085 shows a 4 part collapsible spool-type reel; and U.S. Pat. No. 2,713,525 shows a reel bushing for electrical cable. None of these constructions offer the advantages associated with this invention.

THE INVENTION

OBJECTS:

It is an object of this invention to provide a means for attaching a spacing-collar to a clothes rod which avoids the necessity of dismounting the bar, and the items thereon, in order to insert an end of the rod through an opening in the collar.

It is another object of this invention to provide a specially designed spacing collar for slidable attachment to a clothes bar in order to maintain the proper distance between the garments hanging on said clothes bar without dismounting the bar from its end supports.

It is another object of this invention to provide a universal spacing collar that may be attached to or removed from the bar without having to remove the bar from its supported position or the clothes from the bar.

It is another object of this invention to provide a spacer that is inexpensive to manufacture.

It is another object to provide a clamshell spacer of "single", "double", or "multiple" hanger design.

Still other objects are evident from the drawings, specification and claims.

SUMMARY

Figure 1:
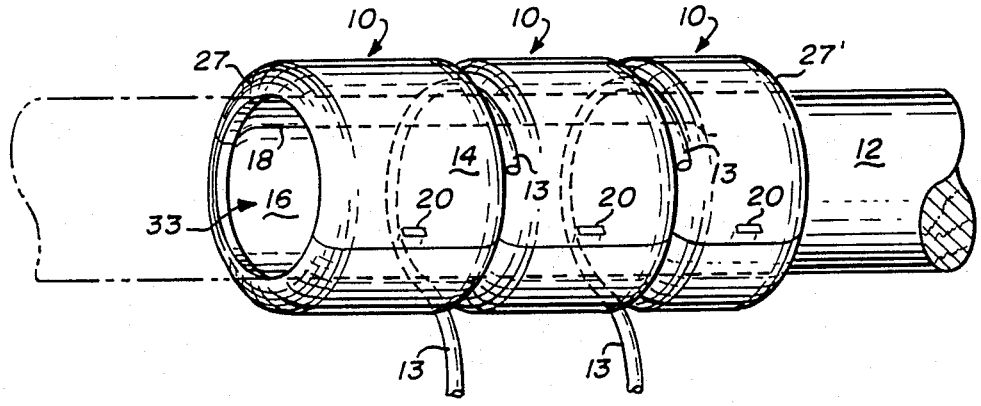
FIG. 1 shows in perspective three spacing collars of this invention snapped onto a clothes bar and with hangers in the proper spacing position therebetween.

The invention is directed to a spacing collar formed from two generally identical sections, each of which is a hemicylinder. Preferably the two sections are hinged along a common straight edge with its opposing section so that the hinged sections may be opened in clamshell fashion to receivingly engage the clothes bar. When the collar is closed around the clothes bar, the edges which define the flat portion of the hemicylindrical boundary of each section come into contact and are retained in the closed position by a securing means. The resulting closed collar is spaced slightly from the bar to permit slidable contact therealong.

The collar may have one or more concentric grooves in its outside surface so that the hook of a hanger may be positioned in each groove. Preferably the collar has no circumferential grooves so that the hanger hooks are retained in direct contact with the bar between adjacent collar units. In either case, a garment draped on each hanger is thereby spaced from its neighboring garment by the separating distance between the grooves or ends of the spacer.

In a preferred embodiment the spacing collar is a cylinder having rounded ends as seen in longitudinal (axial) cross-section, which cylinder is divided into two hemicylindrical sections by a straight hinge joining adjacent edges of the sections in a clamshell-type construction. When the sections are snapped closed around a clothes bar, the edges of each section opposite the hinge are secured together by any convenient snap-type closure. Preferably, the outer diameter of the collar is substantially larger than the diameter of the wire or plastic hook of the hanger so that the hanger cannot hang on the spacer, but automatically is displaced to the proper position between adjacent spacers. The rounded ends ensure the hanger "falls into" position. At each end of the collar the inner diameter of the collar is reduced to slightly larger than the diameter of the supporting bar so that the spacing collar has a shell-like construction. Typical dimensions are 2⅜Δ O.D., 1¾ to 3Δ long, and central aperture about 0.050Δ larger than a 1 7/16Δ bar.

In another embodiment, the collar is elongated and has circumferential grooves in its outside surface so that a hanger hook may be "captured" in each groove. The grooves are spaced from one another at a distance corresponding to the necessary distance between garments.

The outer surface of the collar bordering the grooves and ends of the collar are curved (rounded) so that the hook of a hanger tends to slide into a groove or off an end into contact with the supporting bar thereby securing the hanger in a spaced position relative to the other hangers.

When the collar is closed around the supporting bar, the clamping edges are held together in one embodiment by a clip and receiving hole, disposed respectively on opposing sides of the hemicylinders along the juncture line thereof. An alternate arrangement for securing the clamping edge is an elongated bead-type mating snap on each of the clamping edge which extends along the juncture line. The bead along one clamping edge faces in the direction opposite from the bead along the opposite edge.

The spacing collar is preferably formed from resilient plastic material so that by virtue of the shell-like design and the flexibility of the material, the spacing collar may be withdrawn from or attached to the bar by squeezing the collar to disengage the clip from its hole or the elongated beads from each other and opening the collar.

In still another embodiment, two identical hemicylindrical half shells, each with closure snap type beads along the two side margins may be snapped together; this construction eliminates the need for a hinge. Where a hinge is employed, a living hinge construction is preferred, as that may be molded simultaneously with the hemicylinders so that the living hinge forms a thin web between the two half shells.

DETAILED DISCUSSION OF THE DRAWINGS

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 2:
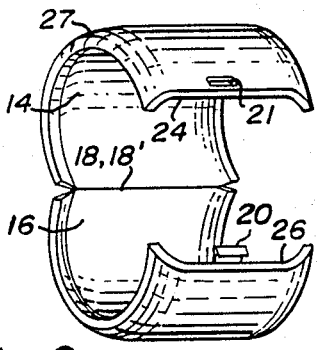
FIG. 2 shows the collar of FIG. 1 open with the bar removed.
Figure 3:
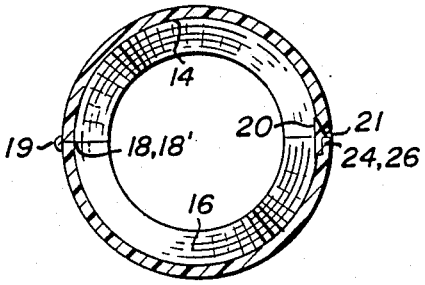
FIG. 3 is a cross sectional view of a closed spacing collar showing one type of closure for locking the spacing collar.
Figure 4:
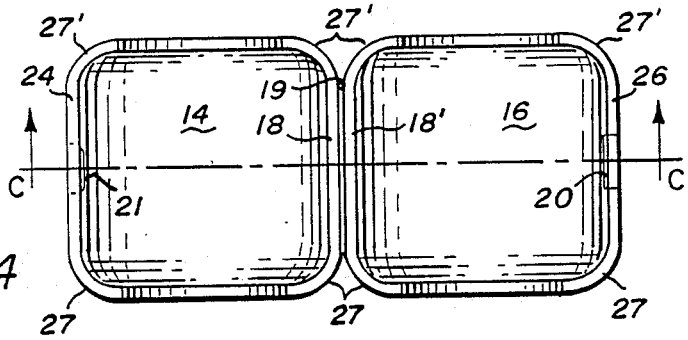
FIG. 4 shows a plan view of an open collar.
Figure 5:
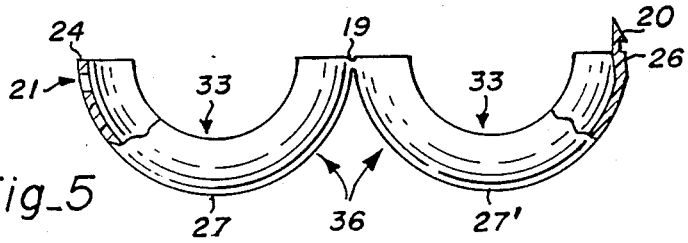
FIG. 5 shows an end elevation view of the collar of FIG. 4.

Turning now to a description of the preferred embodiment with a discussion of the drawings, FIG. 1 shows three spacing collars 10 of this invention disposed in proper orientation on a clothes rod 12. One collar is shown open with the bar removed in FIG. 2. A plan view of an opened spacing collar is shown in FIG. 4, and an end view of an opened spacing collar is shown in FIG. 5.

The spacing collar is shown to comprise hemicylindrical sections, 14 and 16, hinged together along adjacent edges 18, 18' of the sections to form a clamshell construction. In FIG. 1 the hooks 13 of two wire hangers are positioned on the bar between adjacent collar spacers 10. A preferred hinge construction 19 is illustrated in FIGS. 2–5. The hinge 19 comprises a thin strip or web which joins hinging edges 18, 18, of sections 14 and 16, respectively. The lateral length along edges 18, 18, may be varied to suit service needs, e.g., a longer hinge where the collar is to be frequently opened and closed. The width between edges 18, 18, and thickness of the strip is selected to provide adequate flexibility for opening and closing the collar. The two clamping surfaces or edges 24 and 26 opposite to the hinge are locked together by a notched clip 20 attached to section 16 and a mating hole 21 disposed in section 14. The clip and hinge are also shown in cross section in FIG. 3.

Figure 6A:
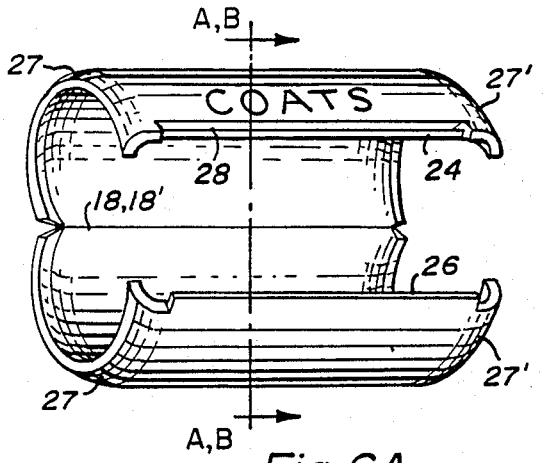
FIG. 6A shows an elongated snap closure for securing the collar in the closed position.
Figure 6B:
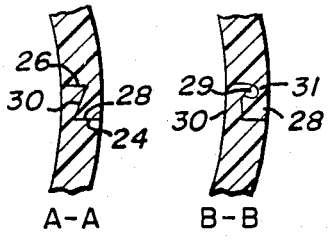
FIG. 6B shows in cross section A—A one snaplock embodiment, and in cross-section B—B a second embodiment.

FIGS. 6A and 6B illustrate a second snap-type embodiment for securing the spacing collar. The construction comprises an elongated bead 28 formed in clamping surface 24 and a correspondingly mating elongated bead 30 formed in clamping surface 26. The beads face in opposite directions. FIG. 6B shows two versions of this securing assembly. In section A—A of FIG. 6B the two leading edges 24, 26 overlap radially to form the lips 28, 30 in a Z-configuration. In view B-B bead 29 engages notch 31. FIG. 6A also illustrates, as compared to FIG. 1 that the axial length of the spacer may be selected to suit the type of clothing. For example, we prefer a spacer outside diameter 2 ⅜Δ and length of from about 1 ⅜Δ to about 3Δ, the longer size being used for suits and coats, intermediate lengths for dress shirts, women's dresses (depending on type & style), and shortest ones for women's blouses, collarless casual shirts and the like. Lengths may be intermixed on rods. The plastic may be color coded to length as a visual guide, or for good looks. Similarly the use, e.g. "Coats", "Shirts", "Blouses" etc., may be molded into or printed onto the exterior surface of the collar.

Figure 7:
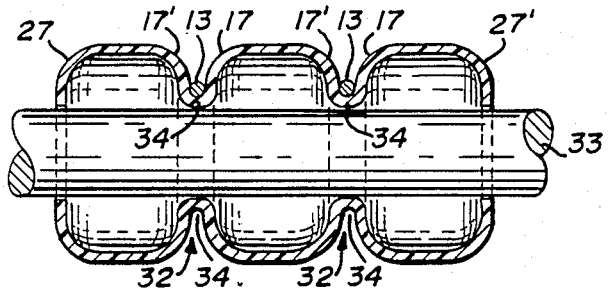
FIGS. 7 and 8 and collars having spaced grooves for supporting more than one hanger, FIG. 7 showing a "double" groove, and FIG. 8 showing a "triple" groove.
Figure 8:
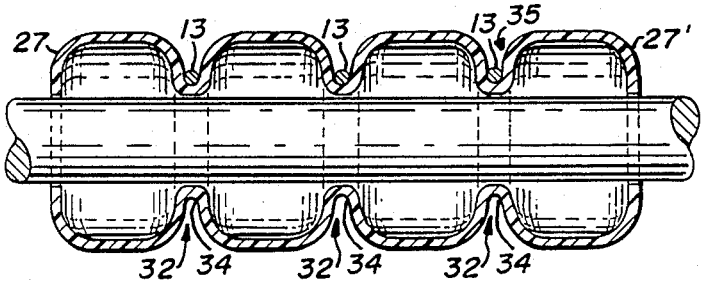

Another embodiment of this invention is illustrated in FIGS. 7 and 8. The spacing collar of this embodiment is longer than the collar of FIG. 1 and has a plurality of chambered circumferential grooves, 34, for receiving the hooks 13 of hangers. A two groove version (a "double") is shown in FIG. 7, and a three (or "triple") version is shown in FIG. 8. Hooks of hangers 13 are also shown.

The opening 33 (FIG. 1) formed when the two shells are snapped closed is just larger than the diameter of the largest clothes rod, 1 7/16Δ to provide sliding clearance. Thus even the clamshell spacer of this invention can be snapped onto the smaller standard rod, 1 5/16Δ, in which case there is a greater gap below the bar, but that does not interfere with the functioning of the spacer. If desired, the closed central aperture size 33 may be fractionally smaller, say by a few thousandths, than the outer diameter of the clothes bar so that the spacer resists lateral movement.

Another important feature of this invention is the cross-sectional curved or chambered shape of the grooves and ends which function to maintain separation of the hangers. The preferred shape of the grooves and ends is illustrated in the cross-sectional views of the spacers of this invention as is shown in each figure.

Figure 9:
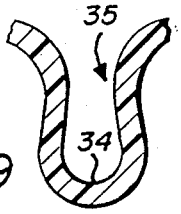
FIG. 9 shows a section of a "necked" groove portion which permits the hook to snap in the groove, preventing it from falling off too easily.

The exterior corners 17, 17, of the grooves and ends 27 are curved or rounded in order to cause the hook of the hangers to slide down into the bottoms of grooves 32. Hangers are also positioned in direct contact with the clothes bar at each end between adjacent spacers as seen in FIG. 1. The bottoms of the grooves 32 may be somewhat wider to accept a wide variety of hanger hook sizes (diameter of wire or plastic hook). The groove side walls may be narrower than the bottoms so that the hangers snap into the groove as shown at 35 in FIG. 9. This helps keep hangers on the bar when clothes are removed from the hangers without first removing the clothes on the hanger from the bar. We are all familiar with the clothes rotatingly dragging the hanger off the bar. This is reduced with narrowed entry groove 35 of this embodiment.

It should be understood that the term clamshell as used herein does not require the presence of the web-type "living" hinge, or any hinge at all, the two hemicylindrical half-shells may be identical, with snap type matingly engaging lips along edges 18, 18' and 24, 26, as shown in FIG. 6B. The two half shells are simply snapped together over the bar.

The hinge need not extend to full axial length of the generally cylindrical side wall 36 of the shells. Note that the hinge terminates medially of the ends, generally just before the commencement of the curved ends 27 and 27'.

It should be understood that various modifications within the scope of this invention can be made by one of ordinary skill in the art without departing from the spirit thereof. For example, pairs of opposed external tab-type snap closures may be used in place of the clip/-hole, or elongated beads. Likewise the center portion of the closed shell need not be round in cross-section (as in FIG. 3) but may be polygonal (triangular, square, rectangular, pentagonal, hexagonal, octagonal etc.) or oval in cross section. In the alternative, for children's clothes rods, the shape may be irregular in cross-section where, for example the shape is an animal or character figure, e.g. Donald Duck, Snoopy, Garfield, an action figure, or the like. We therefore wish our invention to be defined by the scope of the appended claims as broadly as the prior art will permit, and in view of the specification if need be.

PARTS LIST

1.
2.
3.
4.
5.
6.
7.
8.
9.
10. Collar
11.
12. Clothes Bar
13.
14. Hemicylindrical Section
15.
16. "" ""
17. Corners
18. Adjacent Edges of Section
18'. "" ""
19. Hinge
20. Clip
21. Hole
22.
23.
24. Clamping Surface
25.
26. Clamping Surface
27. End Corners
28. Bead lips
29. Bead
30. bead
31. Notch
32. Grooves
33. Opening
34. Groove Bottom
35. Necked-Down Groove

We claim:

1. A spacing collar for receivingly engaging a rod to maintain hooks of garment hangers in predetermined spaced relation to one another which comprises in operative combination:

(a) matingly engaging first and second sections
  (i) each section having a longitudinal extent and comprising an inner surface spaced from and partially enclosing said rod and an outer surface spaced from said inner surface to define a wall therebetween,
  (ii) the longitudinal wall of each section terminating in end walls projecting inwardly toward said rod and terminating just short of said rod to permit sliding engagement with said rod, and
  (iii) each section being bounded by at least one clamping edge;

(b) said first and second sections being joined together along at least a portion of a common hinging edge to receivingly engage said rod in clamshell fashion and cause said hangers to hang on said rod between end walls of adjacent ones of a plurality of said spacing collars enclosed on said rod; and (c) means for locking said clamping edges to one another to slidingly enclose said rod between said sections.

2. A spacing collar as in claim 1 which includes:

(a) means for joining said sections along said hinging edge to permit said sections to open and close along said hinging edge in said clamshell fashion.

3. A spacing collar as in claim 2 wherein:

(a) said joining means comprises a flexible web joining said sections along said hinging edge.

4. A spacing collar as in claim 3 wherein:

(a) said wall of each of said spacing collar section is generally hemicylindrical, terminates in spaced apart ends, and upon closure around said bar is disposed substantially concentric with said bar.

5. A spacing collar as in claim 3 wherein:

(a) said end walls are rounded to permit said hanger hooks to slide onto said bar;

(b) said rounded ends are apertured to receive said bar; and (c) said aperture is sufficiently large to permit said collar to slide laterally along said bar.

6. A spacing collar as in claim 4 wherein:

(a) said longitudinal wall has at least one pair of spaced intermediate walls extending inwardly toward said bar to define a groove concentric with said enclosed bar disposed intermediate the ends of said collar.

7. A spacing collar as in claim 6 wherein:

(a) said grooves form corners with said cylindrical outer surface that are rounded so that hanger hooks slide into said grooves.

8. A spacing collar as in claims 1 or 2 wherein:

(a) said locking means comprises a hook member attached for a first section, and said second section is adapted to engage said hook; and (b) said sections are sufficiently resiliently to permit snap locking and unlocking of said hook from said engaging means.

9. A spacing collar as in claim 8 wherein said hook member and hook engaging means comprise an elongated interlocking bead and mating groove formed along said clamping edges to removably secure said spacing collar on said bar.

10. A clothes hanger spacer as in claim 1 having a cross-sectional shape selected from round, polygonal, and elliptical shapes.

11. A clothes hanger spacer as in claim 1 wherein said spacer is made of a colored plastic.

12. A clothes hanger spacer as in claim 1 wherein said spacer includes indicia identifying a particular use of said spacer disposed in association with at least one exterior surface of said spacer.

13. A clothes hanger spacer as in claim 1 wherein:

(a) at least one section has a fanciful decorative configuration.

14. A clothes hanger spacer as in claim 2 wherein:

(a) at least one section has a fanciful decorative configuration.

* * * * *